United States Patent [19]

Granger

[11] Patent Number: 4,523,539

[45] Date of Patent: Jun. 18, 1985

[54] BOAT ANCHOR

[76] Inventor: Gerald M. Granger, 3203 Hermosa Dr., Youngstown, Ohio 44511

[21] Appl. No.: 561,821

[22] Filed: Dec. 15, 1983

[51] Int. Cl.[3] ..... B63B 21/46

[52] U.S. Cl. ..... 114/299; 114/301

[58] Field of Search ..... 114/297, 299, 294, 301; 52/155

[56] References Cited

U.S. PATENT DOCUMENTS

| | | | |
|---|---|---|---|
| 180,374 | 7/1876 | Robinson | 114/299 |
| 533,668 | 2/1895 | Reeves | 114/297 |
| 1,899,866 | 2/1933 | Harvey | 114/299 |
| 2,413,596 | 12/1946 | Wood, Jr. | 114/299 |
| 3,788,336 | 1/1974 | Steffes | 52/155 |
| 3,809,001 | 5/1974 | Shute | 114/299 |
| 4,210,092 | 7/1980 | Battersby | 114/299 |

*Primary Examiner*—Sherman D. Basinger

*Attorney, Agent, or Firm*—Harpman & Harpman

[57] ABSTRACT

An improved boat anchor assembly to prevent anchor snags and loss of the anchor including an anchor chain attached to a sleeve movably positioned around a shank extending from the anchor. The sleeve automatically locks to the shank in a predetermined manner changing the pivot point of engagement of the anchor chain and the shank effectively freeing the anchor from entangling snags.

3 Claims, 4 Drawing Figures

BOAT ANCHOR

BACKGROUND OF THE INVENTION

1. Field of the Invention

This invention relates to small boat anchors of an anti-snag nature.

2. Description of the Prior Art

Prior art anchors of this type have relied on a variety of different designs that attempt to be snag-free. See for example U.S. Pat. Nos. 180,374, 533,668, 1,899,866 and 4,210,092.

In U.S. Pat. No. 180,374, an anchor is shown having a sliding attachment on the shank from which extends the anchor chain or a rope. The attachment slides freely over the length of the shank to change the relative position of engagement of the anchor chain on the smooth shank.

U.S. Pat. No. 533,668 discloses an anchor having a two-piece pivoted shank. An anchor rope is attached to the base of the shank adjacent the flukes and through a ring on the other end of the pivoted shank. In use, the shank pivots to change the relative point of shank engagement in relation to the anchor chain or line.

U.S. Pat. No. 1,899,866 shows a sleeve movable on a smooth shank. The sleeve is locked to the shank by a pivoting lock member that wedges against the smooth shank.

In U.S. Pat. No. 4,210,092, a boat anchor can be seen in which a shank is an elongated loop on which slides an eyelet element that moved during use to the restrictive U-shaped portions of the elongated loop shank changing its relative point of engagement thereto.

Applicant's device utilizes a shank having a plurality of spaced barbs or indentations that are engaged by a movable sleeve at different points along the shank effectively changing the fulcrum or pivot point of the anchor during retrieval.

SUMMARY OF THE INVENTION

An improved boat anchor assembly that reduces the possibility of lost anchors by changing the point of attachment between the anchor shank and the anchor line. A sleeve movably secured to the anchor line is positioned around the shank which has a plurality of barbs under which the sleeve can be engaged.

DESCRIPTION OF THE PREFERRED EMBODIMENT

Figure 1:
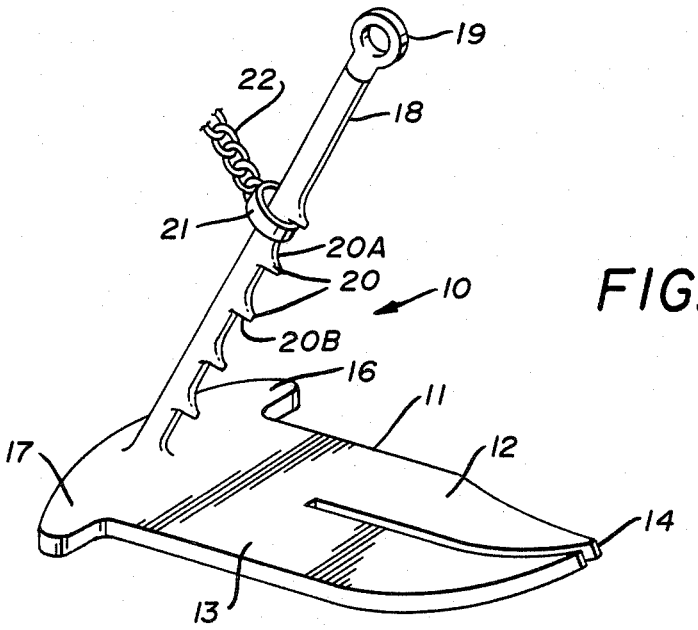
FIG. 1 is a perspective view of the anchor.
Figure 2:
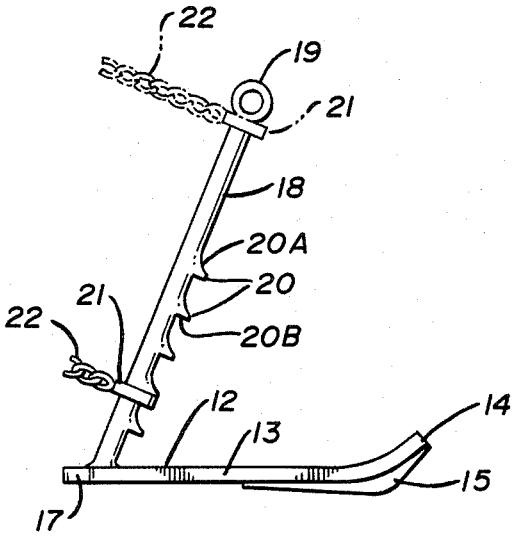
FIG. 2 is a side elevation of the anchor having an optional weight attached thereto.
Figure 3:
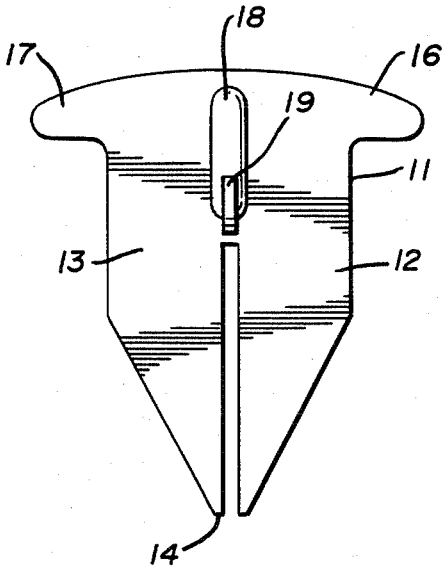
FIG. 3 is a top plan view of the anchor.

A snag resistant anchor assembly 10 having a base member 11 comprising a pair of flat flukes 12 and 13 which are tapered inwardly towards their ends 14 as best seen in FIGS. 1 and 2 of the drawings. The flukes 12 and 13 are curved upwardly from a point midway from their ends 14 and can have a weight 15 added to their underside as best seen in FIG. 2 of the drawings.

The opposite end of the base member 11 is arcuate and extends outwardly from the base 11 at 16 and 17 a sufficient distance providing additional bottom engaging characteristics. A shank 18 is attached to the base member 11 inwardly from the arcuate end between the base extensions 16 and 17.

The shank 18 extends angularly from the base member 11 towards the fluke ends 14 and has a stop ring 19 on the shank's free end. A plurality of spaced barbs 20 are formed on the shank 18 facing the ends 14 of the flukes 12 and 13 as seen in FIGS. 1 and 2 of the drawings. Each of the barbs 20 has a curved upper surface 20A and a relatively flat lower surface 20B that extends outwardly at right angles from the shank.

A movable sleeve 21 has an inner diameter greater than that of said shank 18 and barb 20 and an outer diameter less than that of the stop ring 19 and is movably positioned on said shank 18 for selective engagement with said barbs 20 as seen in FIGS. 1 and 2 of the drawings. It will be seen that there are generally two main areas of engagement for the movable sleeve 21 depending on whether the anchor assembly 10 is being deployed or retrieved.

In operation, as the anchor assembly 10 is being deployed, the sleeve 21 with an anchor line i.e. chain 22 attached shown in broken lines in FIG. 2 of the drawings is engaged against the stop ring 19. When the anchor is to be retrieved, the tension on the anchor line 22 is released allowing the sleeve 21 to drop down the shank 18 and over one of the barbs 20. As the anchor line 22 is then pulled in, the sleeve 21 engages under one of said barbs 20 as shown effectively changing the pivot point of the anchor line engaging the shank thus providing leverage closer to the end of the base member 11 freeing the same from entanglement with under water debris, etc.

Figure 4:
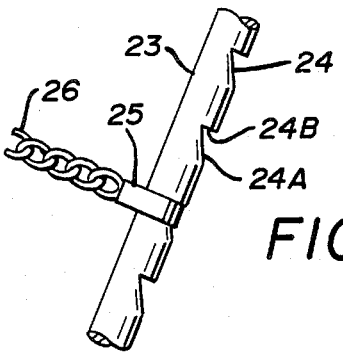
FIG. 4 is an enlarged portion of an alternate form of the invention.

Referring now to FIG. 4 of the drawings, a portion of an alternate anchor shank 23 can be seen wherein a plurality of spaced notches 24 are formed in the shank having a tapered bottom portion 24A and a right angular upper portion 24B.

In operation it will be evident that selective engagement of a sleeve 25 with one of the notches 24 will also effectively change the pivot point of an anchor line 26 as it is attached in relation to the length of the shank 18.

The anchor assembly as described above utilizes all of the well known features of fluked anchors with the added anti-snag feature that selectively changes the relative leverage or pivot points of the anchor line on the shank.

It will be obvious to one skilled in the art that various changes and modifications may be made therein without departing from the spirit of the invention and having thus described my invention

What I claim is:

1. An improvement in a boat anchor assembly, the improvement comprising means for selectively engaging a shank of said anchor in a predetermined manner with an anchor line, said boat anchor assembly comprising the combination of said anchor line, a sleeve of a known length movably positioned on said shank, said line attached to said sleeve, said shank extending at an obtuse angle from the base of said anchor, said base defining a pair of flukes, said means for selectively engaging said shank including said sleeve and line and a plurality of configurations spaced longitudinally on said shank and extending outwardly therefrom and toward said flukes, said configurations defining right angular surfaces in opposed relation to said base and a plurality of curved surfaces in oppositely disposed relation thereto, and means on said shank preventing disengagement of said sleeve therefrom.

2. The improvement in a boat anchor of claim 1 wherein said means for preventing disengagement of said sleeve from said shank comprises an enlarged member on the free end of said shank.

3. The improvement in a boat anchor of claim 1 wherein said sleeve is of an inner diameter greater than the combined diameter of said shank and configurations thereon.

* * * * *